United States Patent [19]

Oelke

[11] 4,388,984

[45] Jun. 21, 1983

[54] TWO-STAGE PRESSURE RELIEF VALVE

[75] Inventor: Erwin S. Oelke, Cypress, Calif.

[73] Assignee: Smith International, Inc., Newport Beach, Calif.

[21] Appl. No.: 232,936

[22] Filed: Feb. 9, 1981

[51] Int. Cl.[3] ..... E21B 9/08; E16C 33/74

[52] U.S. Cl. ..... 184/54; 137/540; 175/228; 175/371; 384/94

[58] Field of Search ..... 175/228, 227; 308/8.2; 137/540; 184/54, 39

[56] References Cited

U.S. PATENT DOCUMENTS

| | | | |
|---|---|---|---|
| 3,721,306 | 3/1973 | Sartor | 308/8.2 X |
| 3,847,234 | 11/1974 | Schumacher et al. | 308/8.2 X |
| 3,854,496 | 12/1974 | Broszeit | 137/540 |
| 3,866,695 | 2/1975 | Jackson | 175/228 |
| 4,161,223 | 7/1979 | Oelke | 175/228 |
| 4,248,484 | 2/1981 | Newcomb | 308/8.2 |

*Primary Examiner*—David H. Brown

*Attorney, Agent, or Firm*—Robert G. Upton

[57] ABSTRACT

A two-stage vent cap type pressure relief valve for a rock bit is disclosed that relieves low pressure gases in a first stage and higher pressure gases in a second stage.

9 Claims, 5 Drawing Figures

TWO-STAGE PRESSURE RELIEF VALVE

BACKGROUND OF THE INVENTION

1. Field of the Invention

This invention relates to relief valve systems for sealed bearing roller cone rock bits.

More particularly, this invention relates to a vent cap pressure relief valve for sealed bearing roller cone rock bits, the valve relieving both low and high gas pressure differentials in stages during operation of the bit.

A rotary rock bit generally consists of a main bit body adapted to be connected to a rotary drill string. A conventional sealed bearing bit usually includes two or more legs integrally connected to form a bit body. Each leg includes a cutter cone rotatively mounted on a journal pin extending from the leg. Bearings are provided between the cutter and the journal pin to promote rotation of the cutter and means are provided on the outer surface of the cutter cone for cutting the formations in a borehole as the bit and cutter rotate.

In lubricated rock bits, a lubrication system is provided which includes an annular seal located at or near the back face of the cutter to prevent the lubricant from leaking from the bearing area to the exterior of the rock bit and to prevent drilling fluid and debris from entering the bearing area. The lubrication system further includes a reservoir filled with lubricant which is typically a high viscosity petroleum grease with passages provided to communicate the reservoir with the bearing space between the cutter cone and the journal pin. A compensator in the form of a resilient bootlike membrane is located within the reservoir with one side of the boot exposed to the lubricant and the other side of the boot exposed to the exterior of the rock bit. The compensator functions to equalize the pressure on the mud side of the seal with the pressure on the lubricant side under varying pressure conditions.

Sealed bearing bits, when operating at high RPM's (revolutions per minute) and at great depths sometimes overheat. The overheating may be attributed to a number of conditions. The bearings may be worn and overheat. Foreign detritus material may penetrate the bearing seals and cause the overheating problem or the rock bit may be abused by the drilling crews. In any event, when the bit overheats, the bearing grease stored in the rock bit reservoir may gasify. Gas under high pressure must have some way to escape the rock bit before damage to the roller cone seals occurs. Once the seals are destroyed, catastrophic failure of the entire rock bit follows shortly thereafter.

The vent cap relief valve of the instant invention provides a two-stage device to relieve gas pressure before the roller cone seals may be destroyed.

2. Description of the Prior Art

U.S. Pat. No. 4,161,223, assigned to the same assignee as the present invention, describes and teaches a single-stage means to relieve high gaseous pressure through a pressure relief valve.

The lubrication system incorporated within the sealed bearing rock bit includes a reservoir of lubricant, communicating via passageways within the bearing area as heretofore described. The reservoir further includes a rubber boot molded around a metal stiffener sleeve. A cover cap is attached to the rubber boot. The rubber boot is in the form of a resilient membrane and is exposed through the cover cap to the exterior of the rock bit and through the inner passageways to the interior of the lubrication bearing area formed between the roller cutter cone and a journal bearing extending from a leg of the rock bit. The vent and pressure relief system comprises an annular seat formed in the back wall surface of the rock bit. A valve face is formed on the rubber boot and is biased against the annular seat in the bit by means of a belleville spring acting on the cover cap. If any excessive pressure in this single-stage valve develops within the lubricant reservoir, the excess pressure is blown off through the single-stage valve seat. An additional feature includes a means in which any internal pressures within the bit may be manually vented through the valve without removing the cover cap by manually prying the cover cap off its seat.

A disadvantage in the foregoing patent is evident in that the valve is actuated only during relatively high gas pressures. Hence the seals protecting the bearing surfaces within the rock bit are subjected to excessive pressures just prior to actuation of the valve. The present invention obviates the excessive pressures subjecting the seals to stress by relieving lower pressures through a first stage valving action which does not lift the cover cap off the main valve seat but rather relieves a segment of the rubberlike seal around the periphery of the seal by allowing a portion of the seal to be depressed into a cavity or annular channel formed in the cover cap flange area above the main valve seat. Where gas pressures suddenly become very high, the seal will ultimately relieve in a second stage by lifting the entire cover cap against a belleville spring off its valve seat as taught by the prior art patent. The ability to relieve lower pressures through only a segment of the cover cap without actuating the main high pressure valve seat prevents any possibility of damage to any of the seals protecting the bearing surfaces interposed between the roller cones and the journals of the rock bit.

SUMMARY OF THE INVENTION

It is an object of this invention to provide a two-stage pressure relief system for a sealed bearing roller cone rock bit.

More specifically, it is an object of this invention to provide a two-stage pressure relief system for sealed bearing rock bits, the first stage relieving relatively low differential pressures from within the lubricant reservoir system without disturbing the relative position of the cover cap while the second stage relieves relatively high differential pressures. The second stage relief system allows the cover cap to lift off its seat against a biasing spring means.

A sealed lubricated rotary rock bit is disclosed having a bit body with at least one leg extending downwardly therefrom. The leg has a journal pin at one end for rotatively supporting a rolling cutter with a seal between the rolling cutter and the journal pin protecting the bearings therebetween. A lubricant reservoir is disposed in the bit body that communicates with the bearing area formed between the cutter and the journal pin. The reservoir further has a pressure compensator disposed therein. The pressure compensator consists of a resilient membrane that separates the reservoir into a lubricant region and a drilling fluid region.

A first means for relieving relatively low differential lubricant pressure around the flexible membrane to the exterior of the bit body is disclosed. The pressure relief means consists of a cover cap. The cover cap forms an annular flange portion having a first substantially radial surface exposed to the exterior of the bit. A second substantially radial surface of the flange overlaps an annular seat formed in a wall of the reservoir. A flange portion is formed by the flexible membrane. The flexible flange has a first substantially radial surface adjacent the second radial surface of the cover cap flange. A second substantially radial surface of the flexible flange forms an annular valve face that is positioned adjacent the annular seat formed by the reservoir. The membrane flange is sandwiched between the second radial surface of the cover cap flange and the annular seat. The second radial surface of the cover cap flange further consists of one or more cavities formed therein. The cavities serve to receive a portion of the flexible flange diverted into the one or more cavities by the excess pressure from within the reservoir. The excess pressure thus is relieved past the valve face of the flexible membrane and the seat in the wall of the reservoir adjacent the one or more cavities.

A second means is disclosed for relieving relatively high differential pressure around the membrane to the exterior of the bit body. The second pressure relief means consists of a means for biasing the cover cap toward the annular seat, compressing the annular valve face in the second radial surface of the flexible membrane flange against the annular seat to prevent flow of lubricant from within the reservoir to the exterior thereof until the relatively high differential pressure lifts the cover cap against the cover cap biasing means when the differential pressure exceeds a pre-selected value.

An advantage then over prior art pressure relief systems is the ability to relieve smaller gas pressures in a first stage, thus preventing any possibility of damage to the seals in the bit. Hence a much better control of gas buildup in the interior of the rock bit is achieved by utilizing the features of the two-stage venting cover cap valve.

Another advantage of the instant invention over the prior art is the ability to relieve lower pressure differentials through only a portion of the main valve seat without disturbing the entire seal surrounding the seat, thus preventing any possibility of the cover cap from becoming misaligned with the main valve seat in the bit body.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
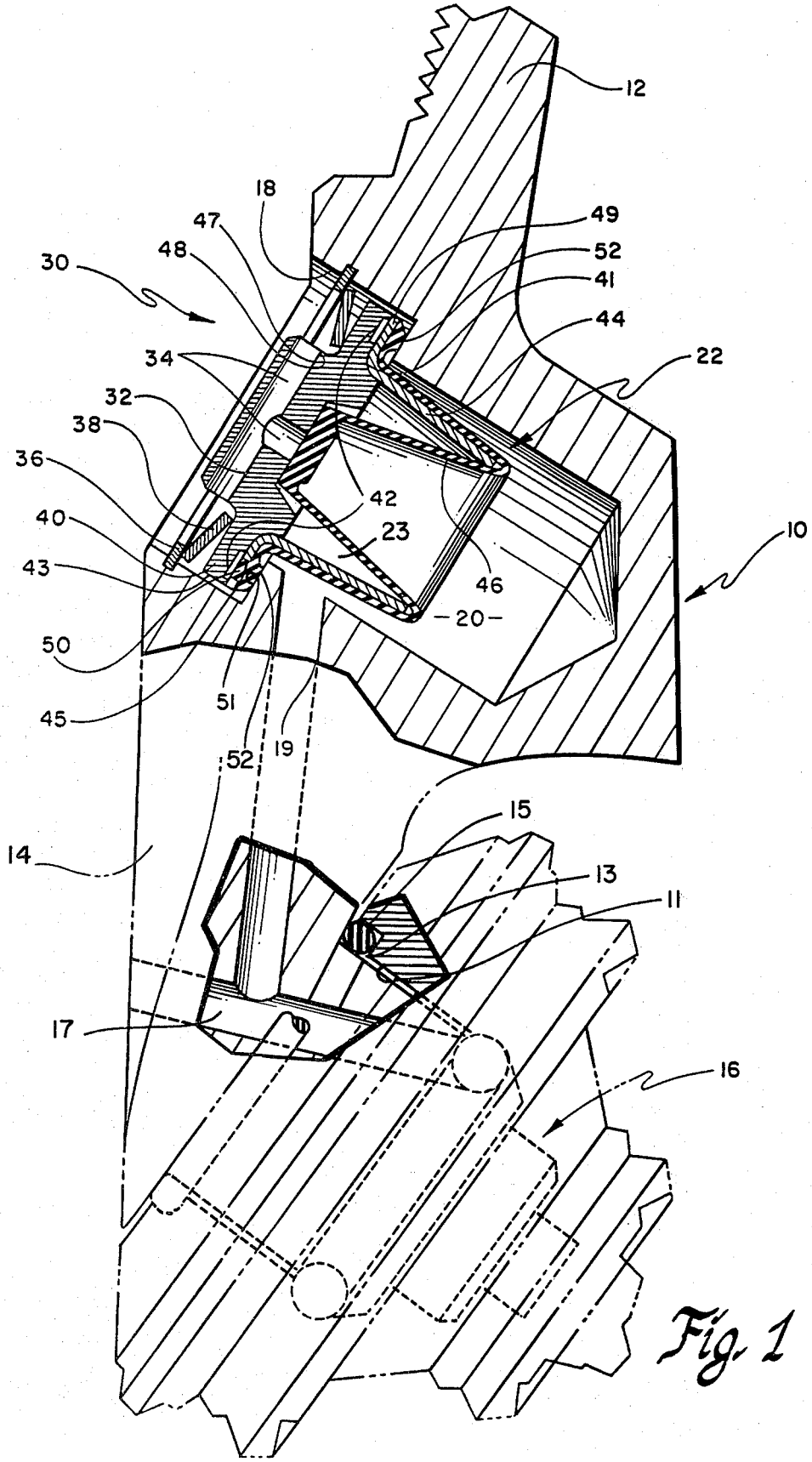
FIG. 1 is a partial cutaway cross section of a leg of a sealed bearing roller cone rock bit illustrating a lubricant reservoir system.

With reference to FIG. 1, the rock bit leg segment, generally designated as 10, consists of pin end 12, shirttail portion 14 and roller cone 16. A lubricant reservoir bore opening 18 is machined into the back of the leg 10. A lubricant passage 19 leads via ball loading passage 17 to the roller cone 16 which is rotatively fixed to a journal 11 extending from the leg 10. An O-ring seal 15 typically isolates bearing space 13 from the external environment. The reservoir bore 18 forms a lubricant reservoir 20.

A pressure compensating boot, generally designated as 22, is positioned within the reservoir 20. A pressure relief cover cap system, generally designated as 30, seals the bore opening 18. The cover cap 32 has a series of pressure compensating passages 34 that communicate with the exterior of the rock bit and the interior 23 of the pressure compensating boot. A cover cap retaining snap ring 36 retains a cover cap biasing means, such as a belleville spring 38, which biases a flange 40 of cover cap 32 against a valve seat 51 formed in the leg 10. Sandwiched between flange 40 and valve seat 50 is a resilient pressure compensating boot 22 made up of a rubberlike material which forms a radially extending flange 50. Flange 50 has a sealing surface 52 that is positioned adjacent valve seat 51 in leg 10. A rigid conically shaped sleeve 44, fabricated from for example a metallic material, forms a radially extending flange 49 that is positioned between the annular resilient flange 50 and the flange 40 of cover cap 32. Flange 49 has one or more openings or orifices 45 in the flange that expose a portion of the resilient sealing flange 50. An annular channel is formed in radial surface 41 of flange 40 of cover cap 32. The channel 42 in surface 41 serves to provide an opening for the resilient material 50 to deform itself therein. The radially disposed flexible material exposed through opening 45 in flange 49 allows excess pressure within reservoir 20 to escape by the area adjacent opening 45 to pass relatively low gaseous pressures from the reservoir system to the exterior of the bit without disturbing the entire seal around valve seat 51.

Much higher gaseous pressures will force the entire cover cap 32 from valve seat 51 by biasing flange 40 against the belleville spring 38, overcoming the spring pressure and lifting the entire cover cap from its seat.

Figure 2:
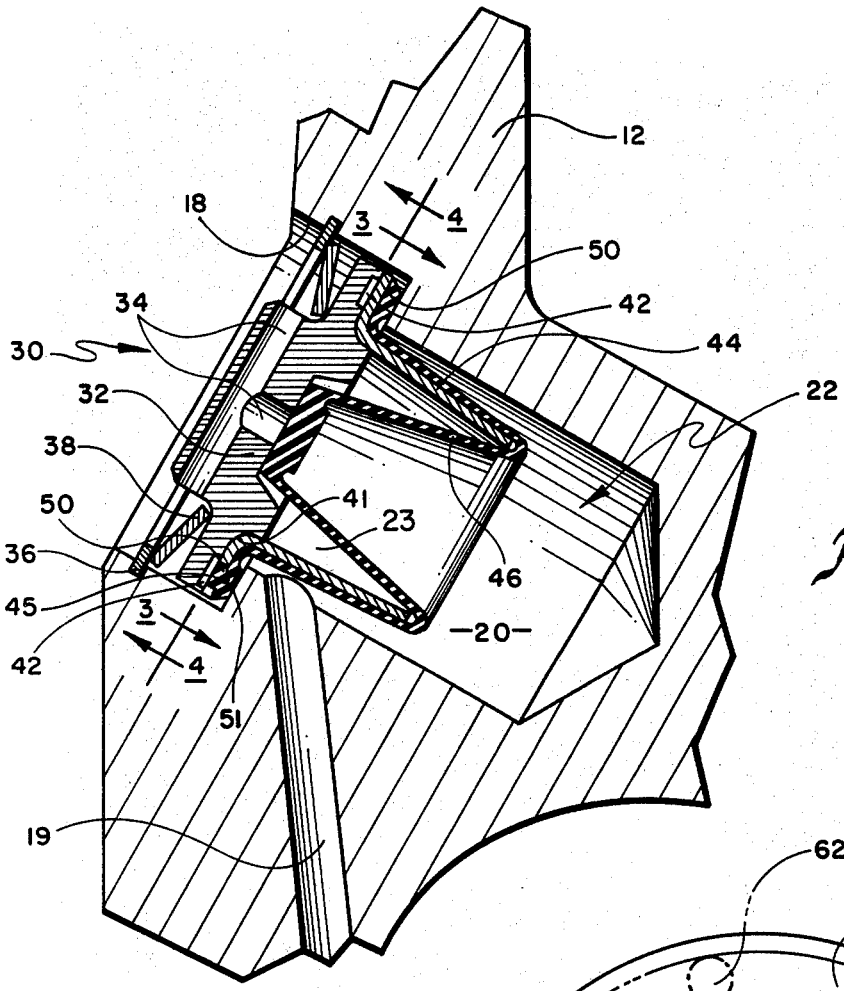
FIG. 2 is an enlarged partial cutaway cross section of the lubricant system and the pressure compensating device positioned within the reservoir of the rock bit.
Figure 3:
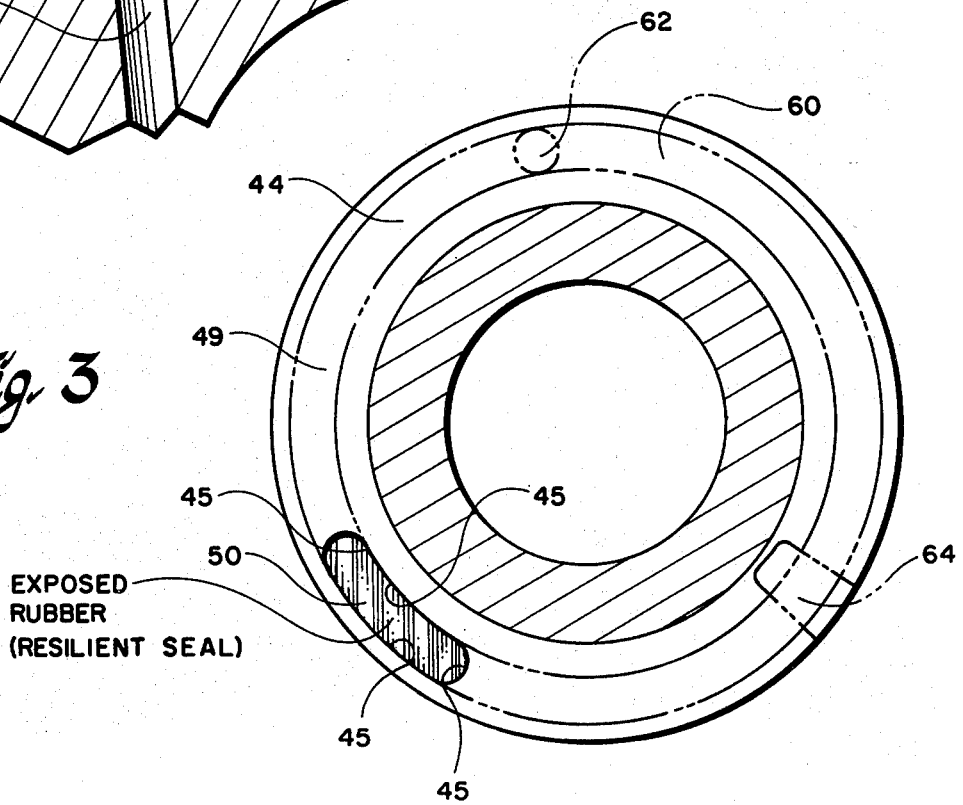
FIG. 3 is a view taken through 3—3 of FIG. 2 illustrating an elongated orifice in the peripheral flange of a truncated cone which is part of the pressure compensator system.
Figure 4:
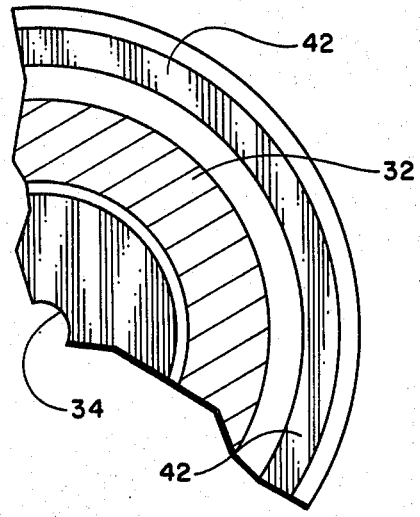
FIG. 4 is a view taken through 4—4 of FIG. 2 illustrating an annular channel or depression in the flange of the cover cap of the compensator.

With reference now to FIGS. 2 and 3, the annular resilient flange portion 50 of boot 22 provides the primary seal for the reservoir system associated with the sealed bearing rock bit. Pressure differentials from, for example, 120 to 150 psi (pounds per square inch) will cause the resilient flange 50, positioned adjacent opening 45 in flange 49, to depress within channel 42 in surface 41 of the cover cap 32. (See FIG. 4.) Since the opening 45 is relatively limited, the escape path for the excess pressure will be through this narrow area on the periphery of cover cap 32. Hence it can readily be realized that the entire seal around seat 51 will not be disturbed but will only be broken through the area adjacent opening 45 of cone 44.

One of the problems with the prior art patent previously described was that the entire seal would be broken and, as sometimes would happen, the cover cap would not reseat itself properly and the cover cap would subsequently leak. As taught by this invention, when low differential pressures are relieved, the seal around area 45 will reseat itself without disturbing the entire sealing surface thus maintaining the integrity of the seal around seat 51.

Figure 5:
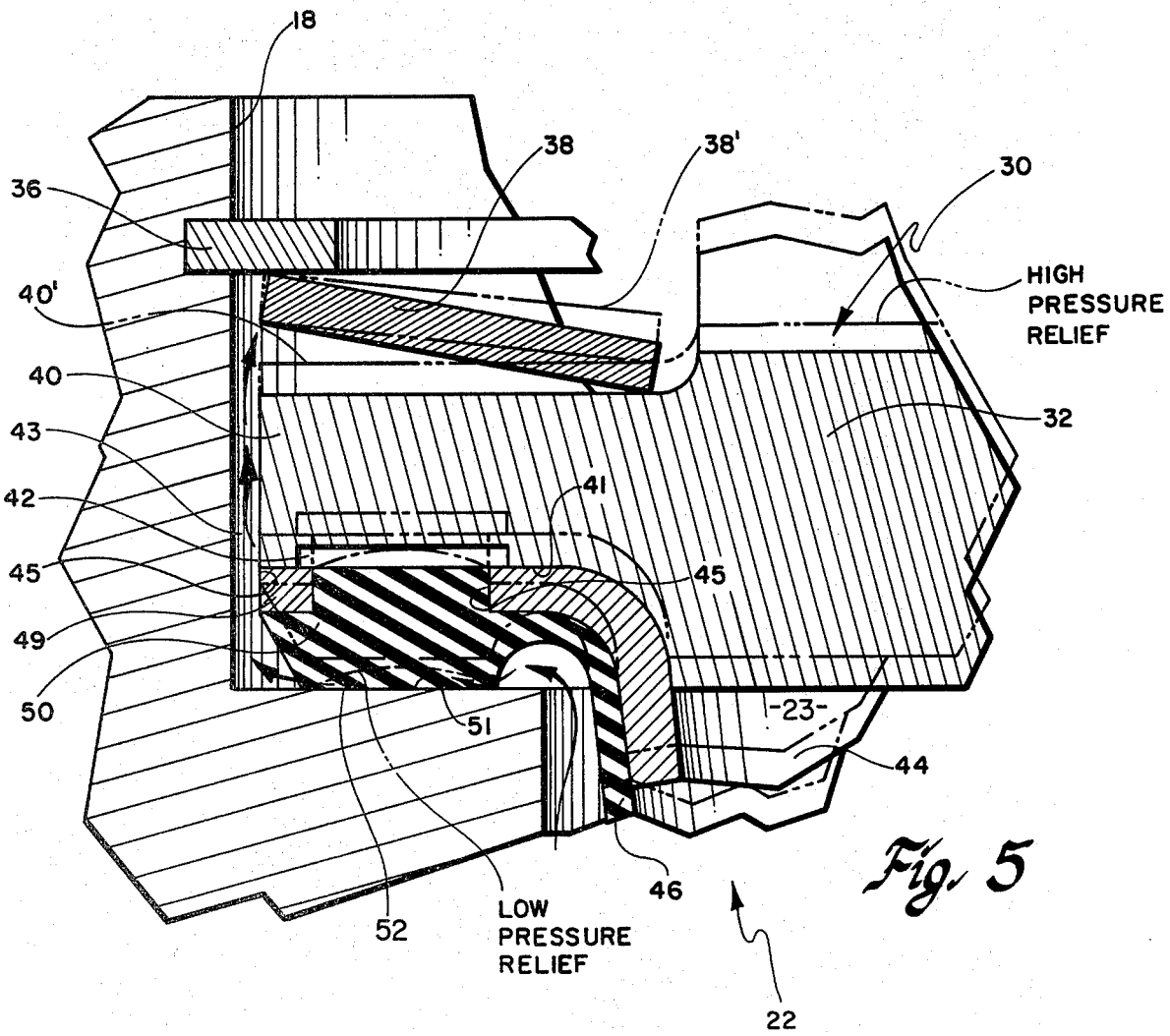
FIG. 5 is an enlarged partial cross section of a portion of the compensator cover cap valve.

A sudden, very high differential pressure in the pressure range of from 180 to 200 psi will lift the entire cover cap as is taught in the prior art patent. This secondary valving action is shown with reference to FIG. 5 where the belleville spring 38' is overcome and the flange 40' of cover cap 32 is lifted off its seat 51, thus allowing the very high differential pressures to escape around the cover cap. The primary low pressure relief system is more clearly shown with reference to FIG. 5. Low pressure differential in the range from 120 to 150 psi will cause the resilient flange portion 50 of boot 22 to depress itself through opening 45 in the metal sleeve 44, thus allowing the resilient material to deform into channel 42 of surface 41 of flange 40 of the cover cap. Hence, as heretofore described, low pressure is relieved through a limited area around the periphery of the seal.

It would be obvious that the seal would function without the intermediate conically shaped sleeve 44. For example, the resilient boot could be positioned adjacent surface 41 of flange 40 and the material could simply depress itself within the annular channel 42 in surface 41.

With reference to FIG. 3, it would additionally be obvious to provide different shaped openings either in the surface 41 of the cover cap or the flange 49 of cone 44 as indicated by the alternate openings 60, 62 and 64.

It would additionally be obvious to provide one or more cavity depressions in surface 41 of flange 40 of cover cap 32 rather than the annular channel 42 as illustrated in the preferred embodiment. However, by providing an annular channel 42, there need not be any indexing devices to position the cover cap precisely within the reservoir opening 18 of rock bit leg 10. Obviously, the resilient boot 22 and sleeve 44 may be positioned anywhere around the periphery of the flange 40 where there is an annular groove for the resilient flange to be deformed therein as previously described. Thus, you need not index the boot to the cover cap.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A sealed lubricated rotary rock bit comprising:

a bit body having at least one leg extending downwardly therefrom, said leg having a journal pin for rotatively supporting a rolling cutter, a seal between said rolling cutter and said journal pin, a lubricant reservoir disposed in said bit body communicating with the bearing area formed between said cutter and said journal pin, said reservoir further having a pressure compensator disposed therein, said pressure compensator comprising a resilient membrane separating the reservoir into a lubricant region and a drilling fluid region, a first valve means for relieving relatively low excess differential lubricant pressure from within said reservoir around said resilient membrane to an exterior of said bit body, said pressure relief valve means comprising a cover cap, said cover cap forming an annular radially disposed flange portion having a first radial surface exposed to the exterior of said bit, a second substantially parallel radial surface of said annular flange overlapping an annular seat formed in a wall of said body forming said reservoir, a flexible flange portion formed by said resilient membrane, said flexible flange of said membrane having a first substantially radial surface positioned adjacent said second radial surface of said annular cover cap flange, a second substantially radial surface of said flexible flange of said resilient membrane forming an annular valve face that is positioned adjacent said annular seat formed in a wall of said body forming said reservoir, said flexible flange of said resilient membrane being sandwiched between said second radial surface of said annular cover cap flange and said annular seat in said body, said annular radially disposed flange of said cover cap forms one or more cavities in said second radial surface, said cavities serve to receive a portion of said flexible flange of said resilient membrane diverted into said one or more cavities formed in said flange of said cover cap by said relatively low excess differential lubricant pressure from within said reservoir, said low excess differential pressure thus being relieved past said valve face of said resilient membrane and said annular seat formed in said wall of said body forming said reservoir adjacent said one or more cavities, and a second valve means for relieving relatively high excess differential pressure within said reservoir around said resilient membrane to the exterior of said bit body, said second pressure relief valve means comprising a means for biasing said annular flange of said cover cap toward said annular seat compressing said annular valve face formed by said second radial surface of said flexible flange of said resilient membrane against said annular seat formed in said wall of said body to prevent flow of lubricant from within said reservoir to the exterior thereof until said relatively high differential pressure within said reservoir lifts said cover cap against said cover cap biasing means thereby relieving said relatively high excess pressure to the exterior of the bit when said differential pressure exceeds a pre-selected value.

2. The invention as set forth in claim 1 further comprising a substantially radially disposed intermediate ring positioned between said cover cap flange and said flexible flange of said resilient membrane, said intermediate ring forming one or more apertures therein to allow a portion of said flexible flange of said resilient membrane positioned adjacent said one or more apertures formed by said intermediate ring to move toward said cover cap flange, thus providing an escape path for said relatively low excess differential pressure within said reservoir to the exterior of said rock bit.

3. The invention as set forth in claim 1 wherein an annular channel is formed in said second radial flange surface of said cover cap, said flexible flange of said resilient membrane being diverted into said channel in said cover cap to relieve said relatively low excess differential lubricant pressure within said reservoir to the exterior of said rock bit.

4. The invention as set forth in claim 1 wherein said relatively low excess differential pressure within said reservoir associated with said first pressure relief means is in the range from 120 to 150 psi.

5. The invention as set forth in claim 1 wherein said relatively high excess differential pressure within said reservoir associated with said second pressure relief means is in the range from 180 to 200 psi.

6. A sealed lubricated rotary rock bit comprising:

a bit body having at least one leg extending downwardly therefrom, said leg having a journal pin for rotatively supporing a roller cutter, and a seal between the rolling cutter and the journal pin, a lubricant reservoir in the bit body communicating with a bearing area formed between the roller cutter and the journal pin, a radially extending annular seat formed in the bit body around the reservoir, a cover cap including an annular flange overlapping the annular seat, a pressure compensator in the lubricant reservoir comprising a resilient membrane separating the reservoir into a lubricant region within the bit body and a drilling fluid region exterior to the bit body and including a flexible flange of said resilient membrane between the annular flange of the cover cap and the annular seat formed in the bit body for sealing against the annular seat, and characterized by:

means for relieving differential lubricant pressure around the resilient membrane to the exterior of the bit body comprising:

at least one cavity in the annular flange of the cover cap in communication with the exterior of the bit body, and a surface on the flexible flange on the resilient membrane exposed to such a cavity, the opposite surface of the flexible flange of the resilient membrane adjacent the annular seat in said body being in communication with the lubricant region whereby a portion of the flexible flange of the resilient membrane can be diverted into such a cavity by excess differential lubricant pressure from within the reservoir, the differential pressure thus being relieved past the flexible flange and annular seat adjacent such cavity.

7. The invention as set forth in claim 6 further characterized by means for biasing the cover cap towards the annular seat for compressing the flexible flange of said resilient membrane against the annular seat for inhibiting flow of lubricant from within the reservoir.

8. The invention as set forth in claim 6 further characterized by an intermediate ring having a radially disposed flange portion positioned between the annular flange of the cover cap and the flexible flange, of the resilient membrane, and at least one aperture through the radially disposed flange portion of said intermediate ring adjacent the at least one cavity in the cover cap to allow a portion of the flexible flange to move into such cavity in said cover cap in response to excess differential lubricant pressure inside the reservoir.

9. The invention as set forth in claim 8 wherein such cavity in the annular flange of said cover cap comprises an annular channel and wherein such an aperture in the intermediate ring extends less than the entire circumference of the ring.

* * * * *